US005327882A

United States Patent [19]

Saringer et al.

[11] Patent Number: 5,327,882

[45] Date of Patent: Jul. 12, 1994

[54] CONTINUOUS PASSIVE MOTION DEVICE

[75] Inventors: John Saringer, Markham; Andrew Galbreath, Toronto, both of Canada

[73] Assignee: Toronto Medical Corp., Pickering, Canada

[21] Appl. No.: 56,543

[22] Filed: May 5, 1993

Related U.S. Application Data

[63] Continuation-in-part of Ser. No. 951,020, Sep. 3, 1992, abandoned.

[51] Int. Cl.[5] ..... A61H 1/02

[52] U.S. Cl. ..... 601/40

[58] Field of Search ..... 128/25 B, 25 R, 26; 482/44–49, 79, 80

[56] References Cited

U.S. PATENT DOCUMENTS

| | | |
|---|---|---|
| 1,688,188 | 10/1928 | Jugo . |
| 1,720,571 | 7/1929 | Retif . |
| 1,833,357 | 11/1931 | Enzler . |
| 3,495,824 | 2/1970 | Cuinier . |
| 4,039,183 | 8/1977 | Sakurada . |
| 4,368,728 | 1/1983 | Pasbrig . |
| 4,474,176 | 10/1984 | Farris et al. . |
| 4,576,148 | 3/1986 | Koerner et al. . |
| 4,619,250 | 10/1986 | Hasegawa . |
| 4,641,832 | 2/1987 | Mattox . |
| 4,679,548 | 7/1987 | Pecheux . |
| 4,724,827 | 2/1988 | Schenck . |
| 4,772,012 | 9/1988 | Chesher . |
| 4,962,756 | 10/1990 | Shamir et al. . |
| 5,067,479 | 11/1991 | Saringer et al. . |
| 5,115,806 | 5/1992 | Greuloch et al. . |

FOREIGN PATENT DOCUMENTS

| | | |
|---|---|---|
| 358024 | 12/1905 | France . |
| 707583 | 1/1980 | U.S.S.R. . |

OTHER PUBLICATIONS

Follow-up report on the electrically driven hand splint, Ketchum et al., The Journal of Hand Surgery, 1979 American Society for Surgery of the Hand, vol. 4, No. 5, Sep. 1979, pp 474 to 480.

*Primary Examiner*—Richard J. Apley
*Assistant Examiner*—Jeanne M. Mollo
*Attorney, Agent, or Firm*—Samuel Meerkreebs

[57] ABSTRACT

A continuous motion device for the therapy and rehabilitation of a patient's hand and fingers comprises a splint adapted to be mounted to the patient's forearm and hand, a gear housing rotatably mounted around a reversible motor, with the reversible motor driving a gear mechanism provided in the gear housing. The gear mechanism driving a digit attachment member in a rotational movement therewith. When actuated, the reversible motor causes the gear housing to rotate about the axis of the motor with the digit attachment member counter-rotating relative to the gear housing about another axis spaced apart from and parallel to the motor axis, whereby the absolute motion of the digit attachment member and therefore of the patient's fingers follow a compound spiral. The compound spiral, depending on the ratios of the gears of the gear mechanism, can follow one of a series of multiple lobed compound spirals, having open or closed loops. The range of motion of the digit attachment member and the speed thereof can be adjusted. Various motions can thus be imparted to the fingers of the patient.

10 Claims, 9 Drawing Sheets

CONTINUOUS PASSIVE MOTION DEVICE

This application is a continuation-in-part of U.S. Ser. No. 951,020 filed Sep. 3, 1992, abandoned.

BACKGROUND OF THE INVENTION

1. Field of the Invention

The present invention relates to continuous passive motion (CPM) devices and, more particularly, to such a device intended for the therapy and rehabilitation of the hand.

2. Description of the Prior Art

Various devices have been contemplated to rehabilitate the hands or the digits thereof through continuous passive motion therapy.

U.S. Pat. No. 1,720,571 issued to Retif on Jul. 9, 1929, discloses an apparatus for exercising the fingers which comprises a flywheel adapted to cause, upon its rotation, a pair of shafts to oscillate. The shafts carry altogether as many collars thereon as there are fingers to exercise. A swivel lever is fixed at a first end thereof by way of a sleeve to each of these collars. The swivel levers are adapted to hold at their second ends the fingers to impart thereto, upon oscillation of the shafts and the collars, various movements in a plane. Various exercises can be obtained depending on the positions of the collars on the shafts.

U.S. Pat. No. 4,368,728, issued to Pasbriq on Jan. 18, 1983, discloses an appliance for training finger joints which includes a plurality of guides mounted in a housing with each of the guides being movable up and down transversely to its longitudinal direction. A plurality of sleeve carriers are slidably mounted on respective ones of the guides. A plurality of finger sleeves extend on top of the housing and are secured to respective ones of the sleeve carriers. A drive is provided for reciprocating the guides up and down with the sleeve carriers and finger sleeves and for reciprocating the sleeve carriers with the finger sleeves along said guides. A horizontal shaft is mounted in the housing for rotation on a first axis. The drive comprises a motor for rotating the shaft. A plurality of eccentric cam wheels are non-rotatably mounted on the shaft. A plurality of levers are pivoted in the housing on a common second axis, which is parallel to the first axis. Each of the levers has a forward end portion, which is spaced from the second axis and constitutes one of the guides and is formed with a longitudinal groove, which receives one of the sleeve carriers. Each the levers rides on the periphery of one of the cam wheels between the groove and the second axis.

"The Journal of Hand Surgery" (pages 474–480, 1979, American Society for Surgery of the Hand) is of interest as disclosing a traction device motor driven through extension flexion for reciprocally and independently driving the digits of a ptient hand along an a curved plastic trolley support. The motor drives a hidden drum, on the periphery which are mounted four rings driven by drive arms mounted directly on the surface of the drum. The rings each have two adjustable tabs that can be moved along the circumference of the ring, the position of these tabs directly relating to the location of trolleys riding on the curved support. Calibration marks assist in locating the tabs in reference to the desired operating range of the trolley which can be each custom set to operate within a determined tolerance range. Similarly, U.S. Pat. No. 4,724,827, issued to Schenck on Feb. 16, 1988, discloses a dynamic traction device for the traction and the flection of an injured area to expedite the healing of bone or soft tissue fractures or other tissues in a patient. For instance, an appendage having a fractured bone is placed in traction and at the same time continuously flexed and extended as is a particular Joint proximally connected to the fractured bone in order to prevent joint tissue deterioration. The portable finger dynamic traction device includes a support structure which is attachable to the body to substantially immobilize joints of the body proximal to the particular joint as is necessary to promote flexing of the proximal joint. Associated with the support structure is an actuator reciprocally movable in a substantially arcuate path which is substantially in the plane of the natural bending movement of the particular joint, distally outward of the fracture and with the particular Joint substantially at the radial center. A tension member tractions the broken appendage to the movable actuator so that the appendage follows the reciprocating movement of the actuator to flex the joint.

U.S. Pat. No. 4,962,756 issued to Shamir et al. on Oct. 16, 1990 and assigned to Danninger Medical Technology, Inc., discloses a portable CPM device which causes controlled continuous passive motion of the digits of a patient's hand. For example, the device when mounted on the dorsal surface of the hand for imparting motion to the four fingers comprises a housing with a motor driven actuating mechanism located therein. The actuating mechanism comprises a reciprocating linear actuation linked to a rotary actuator so that, for therapy of the fingers, the device is rotated about an axis located on the patient's hand that extends transverse to the longitudinal axis of the patient's arm and simultaneously to an actuating arm which is linked to the digits driven back and forth. Linear and rotational elements of actuation are produced, whereby operation of the motor causes the actuating mechanism to drive the digits in a spiral or, more particularly, in a section of a spiral about the axis of rotation, whereby a full palmar closure of the digits in the hand is achieved.

In U.S. Pat. No. 4,679,548 issued on Jul. 14, 1987 to pecheux, the company "Compagnie Générale de Matériel Orthopédique" have also developed a continuous passive motion device which imparts to the fingers a movement resembling that of part of a spiral.

No previous machine provides for the complete motion of all of the joints of the digits, which the present invention achieves through the application of a compound spiral motion to the fingers.

SUMMARY OF THE INVENTION

It is therefore an aim of the present invention to provide an improved continuous passive motion device for therapy of the hands which imparts full physiological motion to the digits of the hand through the use of a compound spiral motion.

Therefore, in accordance with the present invention, there is provided a continuous passive motion device for therapy of a patient's hand comprising a splint means adapted to be attached to the patient's forearm and hand, an actuator means mounted to said splint means and comprising a motor means for driving a transmission means provided in a housing rotatably mounted to said motor means along a first axis, a digit attachment means extending from said housing and adapted for pivoting relative thereto about a second axis spaced apart from and parallel to said first axis, said digit attachment means being adapted for attachment to at least one of the patient's fingers, said transmission means upon actuation of said motor means causing said digit attachment means to counter-rotate about said second axis and relative to the rotation of said housing about said first axis, whereby said at least one finger is driven along a reciprocal path of motion corresponding at least to a portion of a compound spiral.

BRIEF DESCRIPTION OF THE DRAWINGS

Having thus generally described the nature of the invention, reference will now be made to the accompanying drawings, showing by way of illustration a preferred embodiment thereof, and wherein.

DESCRIPTION OF THE PREFERRED EMBODIMENTS

Figure 1:
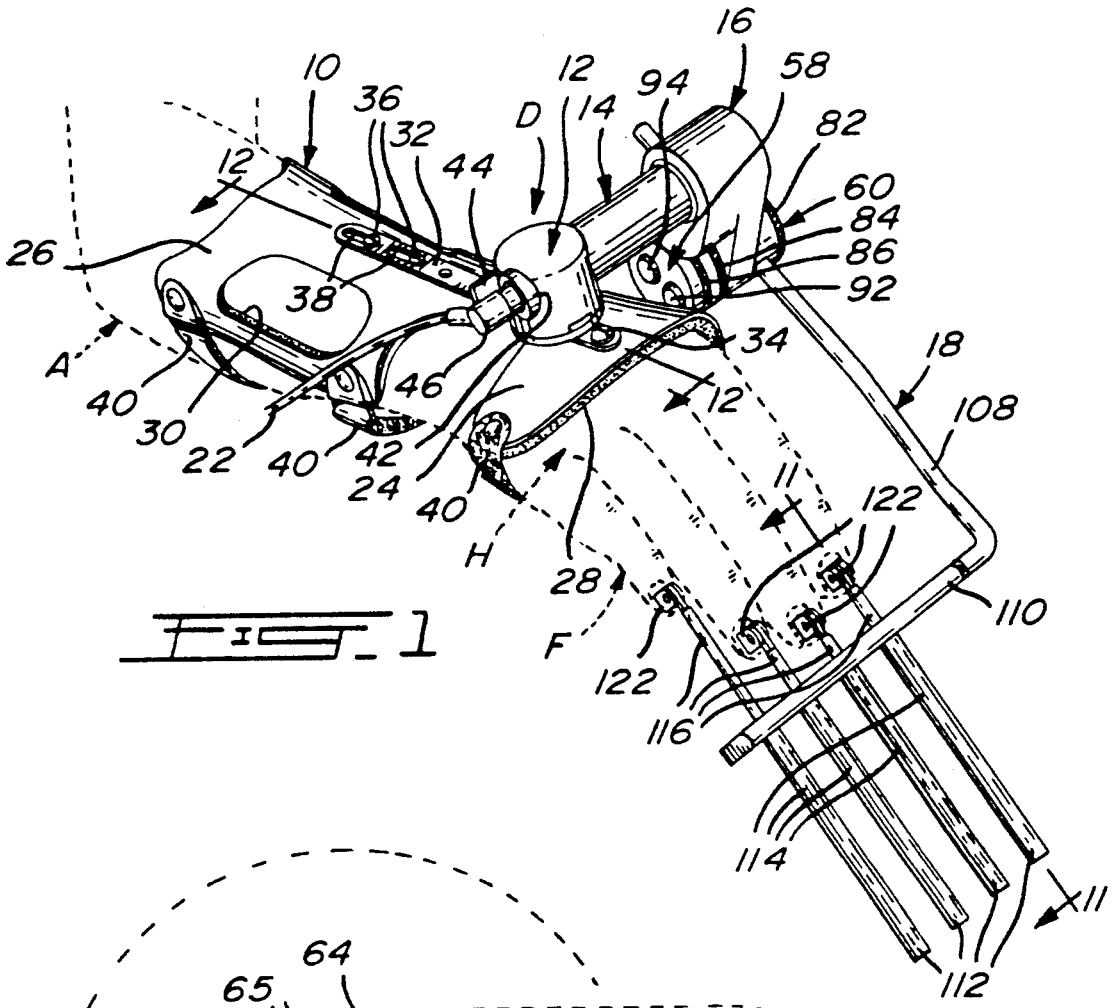
FIG. 1 is a perspective view of a continuous passive motion (CPM) device in accordance with the present invention showing in dotted lines a patient's arm and hand onto which is attached the continuous passive motion device.
Figure 2:
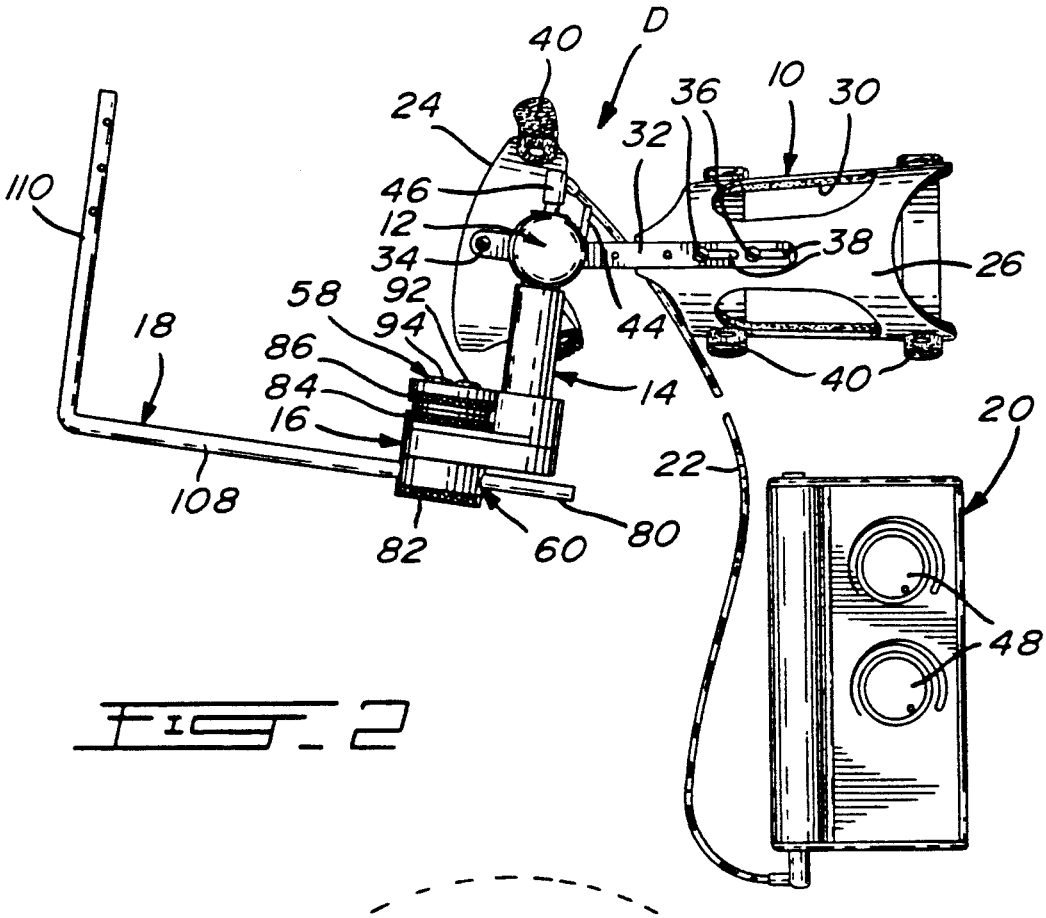
FIG. 2 is a top plan view of the continuous passive motion device illustrated in FIG. 1 and showing a controller therefor.

In accordance with the present invention, FIG. 1 illustrates a continuous passive motion device D, hereinafter referred to as the CPM device D, which is shown attached to a patient's right forearm A and hand H. The CPM device D comprises a splint 10, a mounting bracket 12 secured to the splint 10, a motor assembly 14 slidable in the mounting bracket 12 along an axis which is substantially transverse to the axis of the forearm A, a gear housing 16, and a digit attachment manifold or member 18. A pocket-size patient controller 20 into which are conveniently housed the batteries and electronics is connected to the motor assembly 14 by way of a cable 22, as best seen in FIG. 2.

Figure 12:
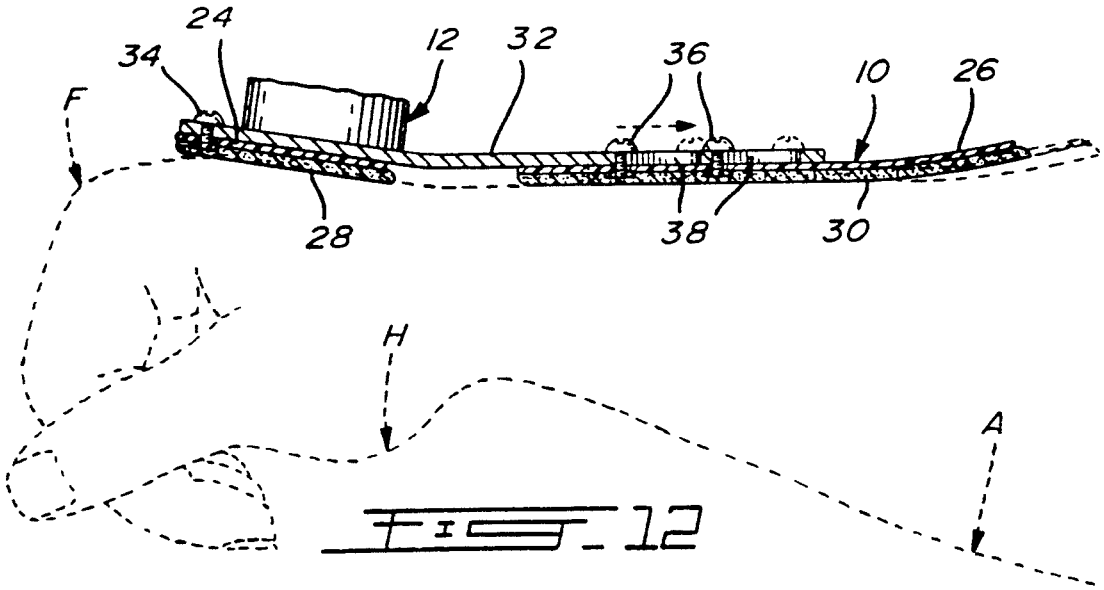
FIG. 12 is a cross-sectional view taken along lines 12—12 of FIG. 1 and showing a right-hand splint of the CPM device.

The splint 10 comprises two molded plastic sections 24 and 26, with respective paddings 28 and 30 being adhesively mounted on the undersides thereof, and an elongated bracket 32 extending between the plastic sections 24 and 26 and joined thereto by screws 34 and 36, respectively. Longitudinal oblong openings 38 are defined in the elongated bracket 32 which receive the screws 36, whereby the distance between the two plastic sections 24 and 26 can be adjusted depending on the shape of the patient's forearm A. Straps 40 are provided for attaching the splint 10 around the patient's forearm A. -Right-hand and left-hand splints 10 are produced for accommodating the patient's left and right forearms A and hands H. FIG. 12 illustrates the layered configuration of the splint 10.

On top of the plastic section 24 of the splint 10, the mounting bracket 12 is slidably mounted on a track which is secured to the elongated bracket 32 to allow for the adjustment of the position of the mounting bracket 12 for a range of hand dimensions. The mounting bracket 12 defines a substantially horizontal opening 42, the axis which is substantially perpendicular to the longitudinal axis of the patient's forearm A. The motor assembly 14, as indicated hereinabove, is slidably engaged in the opening 42 of the mounting bracket 12 in order to allow the digit attachment member 18 to be adjusted with respect to fingers F of the patient. For securing the motor assembly 14 in a select position within the mounting bracket 12, the mounting bracket 12 is provided with a lever 44 which acts on a cam (not shown), in a conventional well-known manner.

The motor assembly 14 which is adapted to drive the gears of the gear housing 16 as it will be described in details hereinafter is operated by the patient controller 20 with the cable 22 providing the junction therebetween being removably connected at its end 46 to the motor assembly 14. The motor assembly 14 includes a reversible motor. The angular speed of the reversible motor and the load sensitivity for reversing the direction of the motor are adjusted by a pair of dials 48 provided on the portable patient controller With reference to FIGS. 3 to 8 and, more particularly, to FIGS. 3 to 6, the gear housing 16 comprises a gearing mechanism generally indicated by 50 which includes a series of gear clusters 52, 54 and 56 which will be described in details hereinafter, a motion limiting mechanism generally indicated by 58, and a mechanism 60 for receiving and selectively positioning the digit attachment member 18 with respect to the fingers F of the patient.

Figure 6:
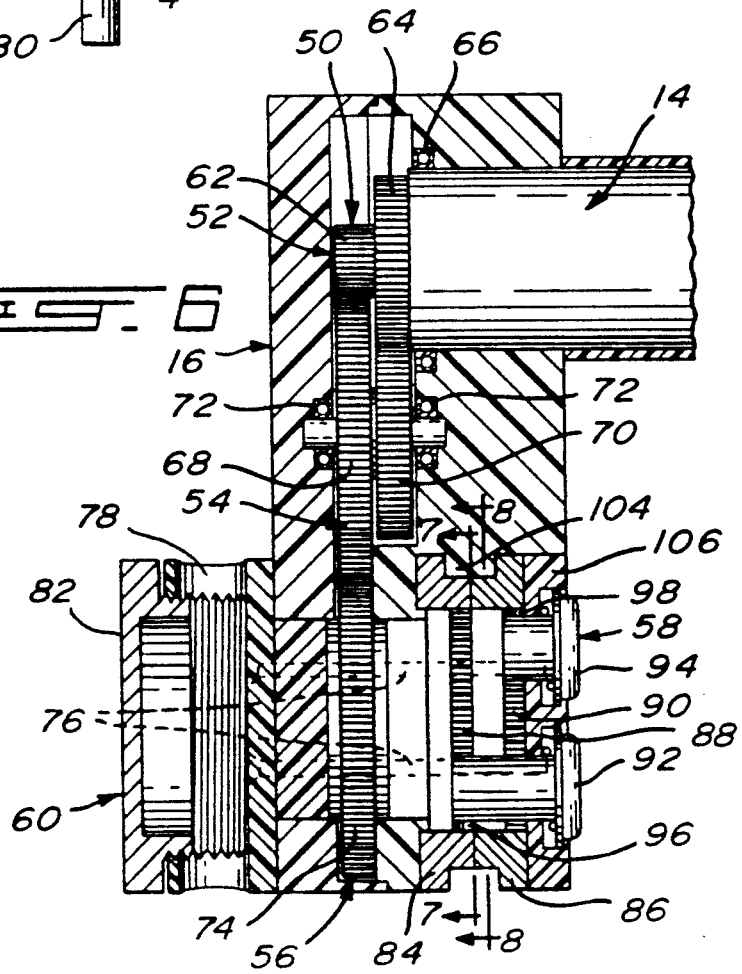
FIG. 6 is a cross-sectional view taken along lines 6—6 of FIG. 4 showing the gear mechanism and the adjustable motion limiting mechanism which control the angular displacement of the CPM device.

The first gear cluster 52 of the gear mechanism 50 includes a pinion 62 and a fixed gear 64 which is fixedly mounted by screws 65 (FIG. 4) inside the gear housing 16. The pinion 62 is driven by the motor of the motor assembly 14, with the gear housing 16 being rotatably mounted around the motor assembly 14 by way of bearings 66, as seen in FIG. 6. The second gear cluster 54 includes first and second gear wheels 68 and 70, which are fixedly mounted one to the other and which are rotatably mounted inside the gear housing 16 by way of a pair of bearings 72. The first gear wheel 68 meshes with the pinion 62, whereas the second gear wheel 70 meshes with the fixed gear 64, The third gear cluster 56 comprises a third gear wheel 74 which is in meshed engagement with first gear wheel 68. The third gear wheel 74 is fixedly mounted by screws 76 to the mechanism 60 carrying the digit attachment member 18 and to the rotatable portion of the motion limiting mechanism 58, with details thereon being provided hereinbelow.

Figure 5:
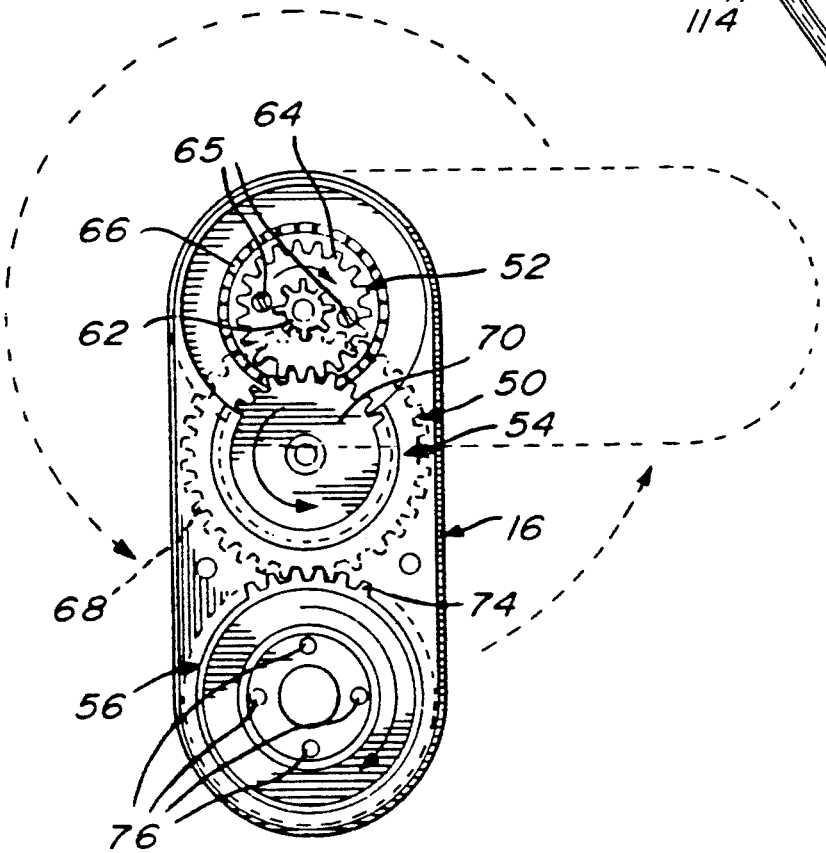
FIG. 5 is a cross-sectional view similar to FIG. 4 showing further details of the gear mechanism.
Figure 4:
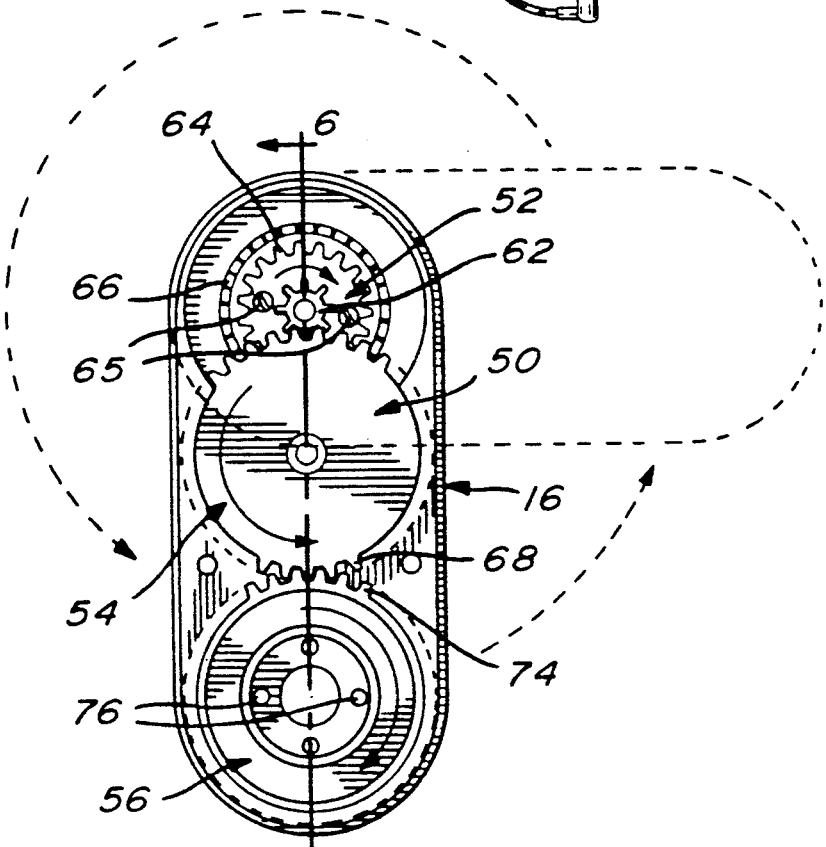
FIG. 4 is a cross-sectional view taken along lines 4—4 of FIG. 3 showing the gear mechanism of the CPM device.

Therefore, rotation of the motor assembly 14 will cause the pinion 62 to rotate and the ensuing rotation of the first, second and third gear wheels 68, 70 and 74 and thus of the mechanism 60 and of the portion of the motion limiting mechanism 58 which is rotatably mounted to the gear housing 16. Also, the second gear wheel 70 being in meshed engagement with the fixed gear 64 will cause the gear housing 16 to rotate about the motor assembly 14 as the second gear wheel 70 climbs around the fixed gear 64. Therefore, the complete gear housing 16 shown in FIG. 6 will rotate around the motor assembly 14 aside from the fixed gear 64. Accordingly, the digit attachment member 18 will pivot with the relative rotation of the third gear wheel 74 and will also rotate about the motor assembly 14 in view of the rotation of the gear housing 16. As Seen in FIGS. 4 and 5, the gear housing 16 will rotate opposite the mechanism 60 attached to the third gear wheel 74 and thus opposite to the rotation of the digit attachment member 18. Therefore, the third gear wheel 74 and the digit attachment member 18 counter-rotate about two axes, both driven by a same motor, namely the axis of the third gear wheel 74 itself and the axis of the motor which is also the axis of the pinion 62 and of the fixed gear 64.

The mechanism 16 for carrying and selectively positioning the digit attachment member 18 defines a non circular hole 78 having a cross-section similar to that of the end 80 of the digit attachment member 18 which is engaged therein. Therefore, the digit attachment member 18 is slidable in and out of the hole 78 of the mechanism 60 without being able to rotate therein. An enlarged screw 82 which engages a threaded opening defined in the mechanism 60 is adapted to abut the planar surface of the end 80 of the digit attachment member for maintaining the same in a selected position with respect to the gear housing 16.

Figure 7:
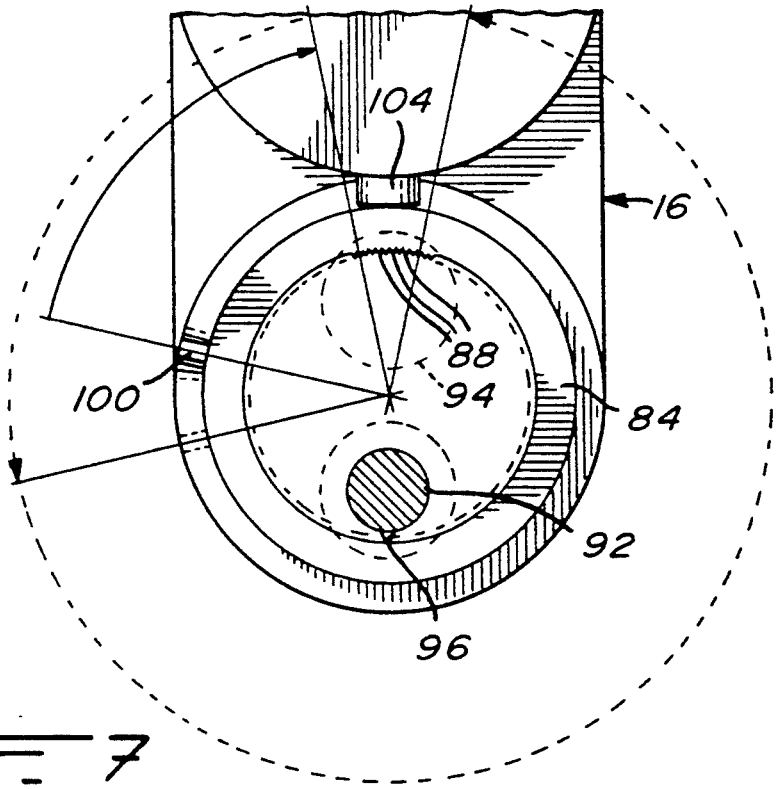
FIGS. 7 and 8 are cross-sectional views taken respectively along lines 7—7 and 8—8 of FIG. 6 and showing further details of the motion limiting mechanism.
Figure 8:
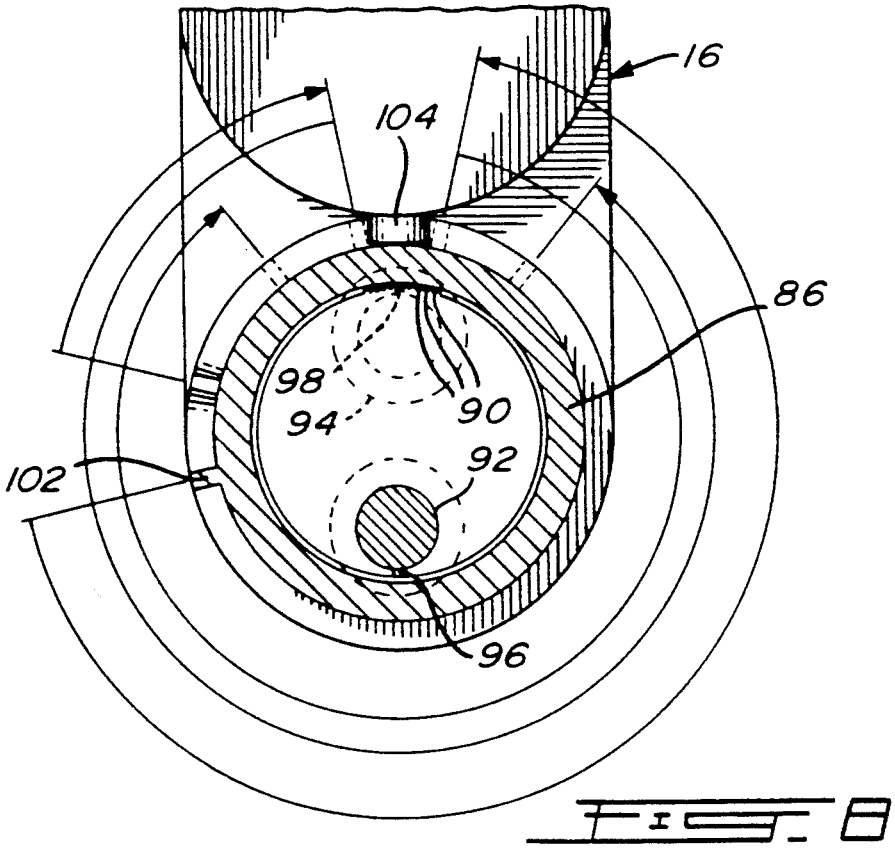

Now referring to FIGS. 3 to 6, the motion limiting mechanism 58 is provided to apply at various stages of the rotation of the third gear wheel 74 a load which will cause the motor to reverse. The motion limiting mechanism 58 comprises facing first and second rings 84 and 86, respectively, provided with inner gear teeth 88 and 90 defined in an annular portion of their respective inner surfaces. Spring-loaded first and second push buttons 92 and 94 define, as seen in FIGS. 7 and 8, radially oriented needles 96 and 98, respectively which engage the gear teeth 88 and 90 of the first and second rings 84 and 86, respectively. It is easily understood that when the push buttons are pushed inwardly towards the gear housing 16, the respective needles 96 and 98 thereof slidably disengage from the gear teeth 88 and 90, whereby the first and second rings 84 and 86 can be freely rotated around the motion limiting mechanism 58.

Figure 3:
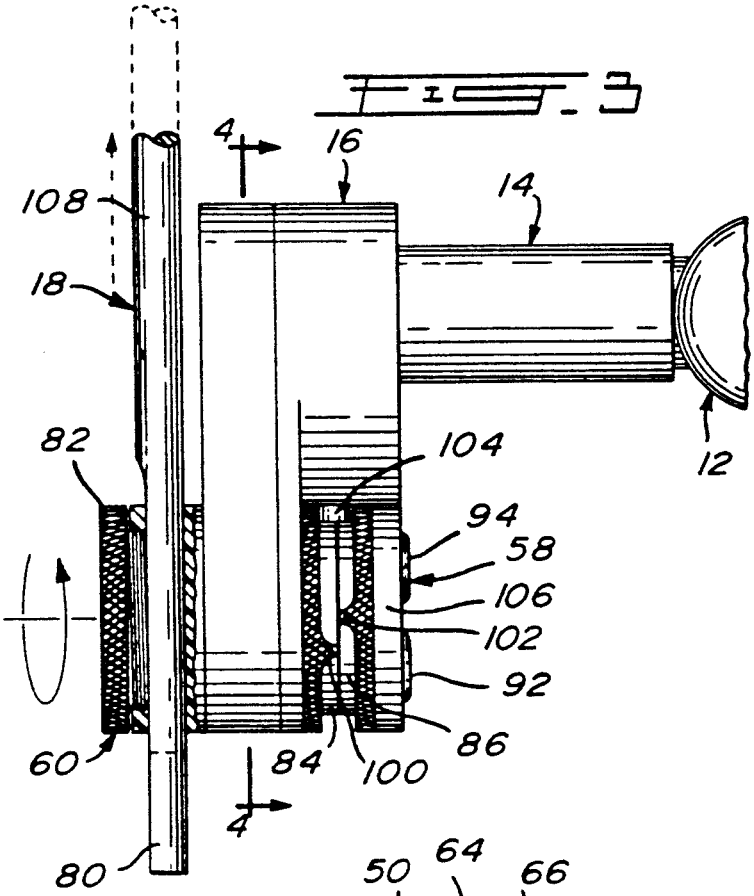
FIG. 3 is an enlarged partly cross-sectional top plan view of a section of the device shown in FIG. 2.

As seen in FIG. 3, the outer surfaces of the first and second rings 84 and 86 respectively define lateral tabs 100 and 102. The gear housing 16 includes an obstruction 104 which engages the channel defined by the facing first and second rings 84 and 86, and which will be abutted by one or both of the tabs 100 and 102 at a certain point and time during the rotation of the first and second rings 84 and 86 which rotate with the third gear wheel 74 and with the mechanism 60 onto which is secured the digit attachment member 18.

Therefore, the rotation of the third gear wheel 74 will cause the rotation of the first and second rings 84 and 86, of the first and second push buttons 92 and 94 and of an end cap 106 provided for closing the motion limiting mechanism 58 and for maintaining set therein the spring-loaded push buttons 92 and 94.

Accordingly, the tabs 100 and 102 can be relatively positioned with respect to one another and with respect to the digit attachment member 18 in order to impart to the .fingers F of the patient various compound spiral motions. It is readily understood that when one (or both) of the tabs 100 and 102 contacts the obstruction 104 the direction of rotation of the motor is reversed. This is illustrated with arrows in FIGS. 7 and 8.

Figure 11:
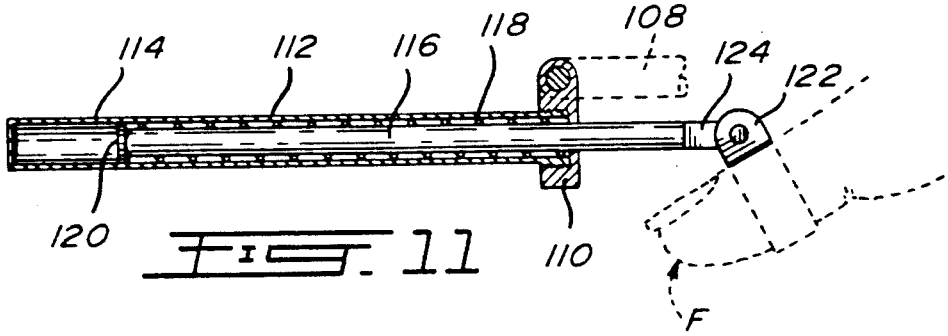
FIG. 11 is a cross-sectional view taken along lines 11—11 of FIG. 1 and showing a digit attachment.

Now referring to FIGS. 1 and 11, the digit attachment member 18 is of L-shaped configuration and includes a longitudinal rod section 108 and a transversal rod section 110 fixedly mounted to the longitudinal rod section 108. It is also contemplated to have the transversal rod section 110 slidably mounted to the longitudinal rod section 108 along an axis perpendicular to the finger rod axes. The longitudinal rod section 108 is engaged in the hole 78 of the mechanism 60 of the gear housing 16. The transversal rod section 110 extends in front of the fingers F of the patient and includes four spring-loaded digit attachments 112 pivotally mounted thereto. Each digit attachment 112 includes a cylinder 114 and a spring-loaded plunger 116 slidably engaged therein, with a spring 118 being compressed between a head 120 of the plunger 116 and a wall of the digit attachment 112 provided at the open end of the cylinder 114 and formed by the transversal rod section 110. A finger attachment device 122 is pivotally mounted at a free end 124 of the plunger 116. In another embodiment, which is not shown, the spring 118 is disposed outside of the cylinder 114 and is mounted between a forward free end thereof and the plunger 116 at a location adjacent to the free end 124 of the plunger 116. With this arrangement, the springs can be detachably mounted and thus be easily replaced with other springs with different spring forces, when required.

Figure 9:
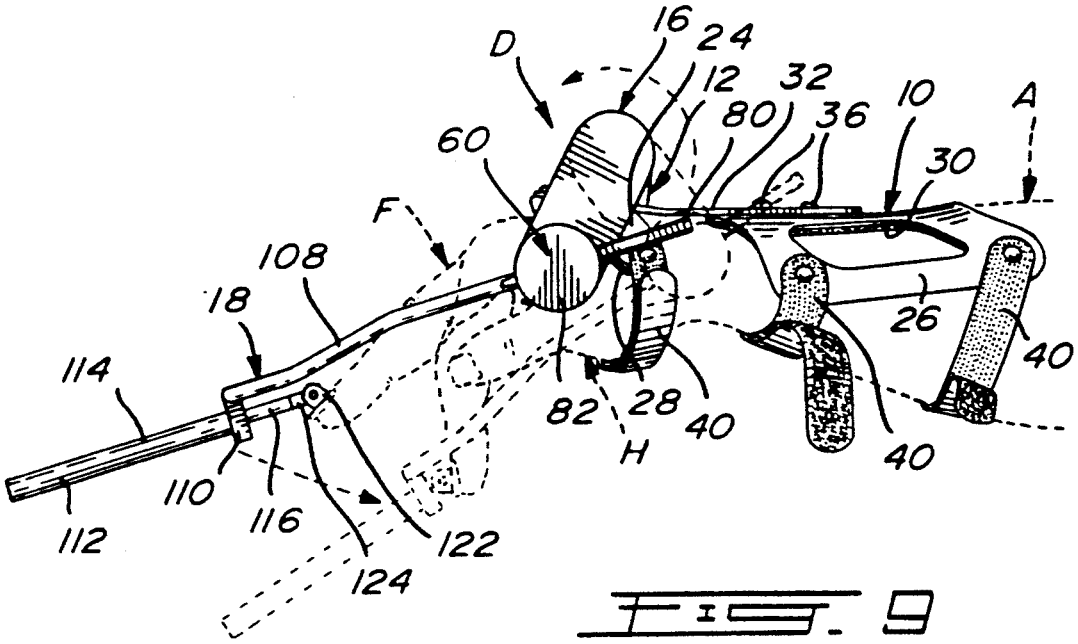
FIGS. 9 and 10 are elevation views of the present CPM device in operation on a patient's hand which is shown in phantom lines, and also illustrating in phantom lines various positions of the CPM device during a cycle.
Figure 10:
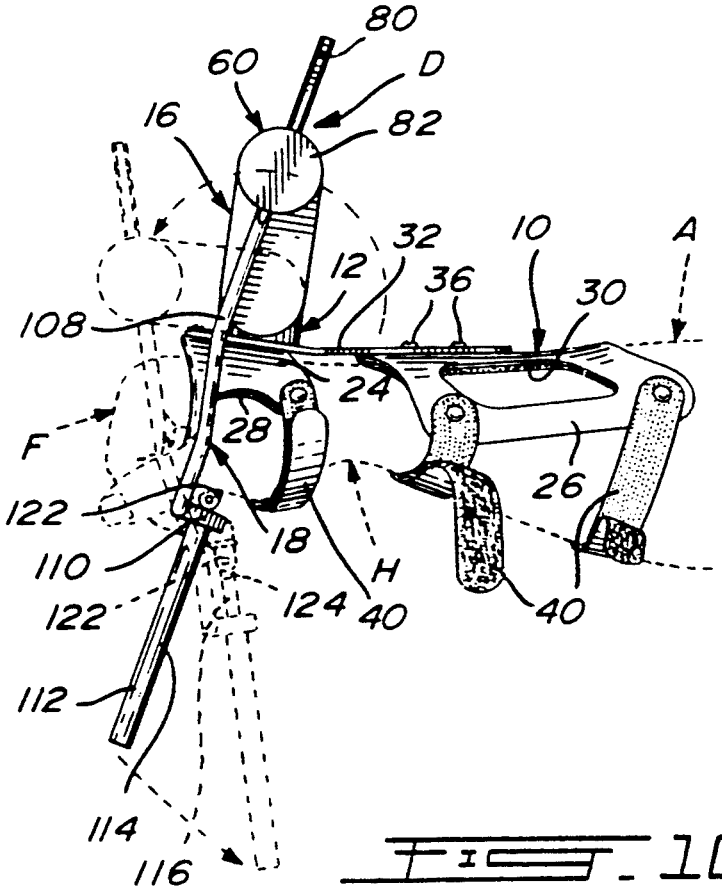

FIGS. 9 and 10 illustrate portions of the open loop compound spiral motion imparted to the fingers F by the present CPM device D. FIG. 9 shows the fingers F being displaced from a full extension position towards a full flection position, with FIG. 10 showing the fingers P close to this full flection position. In the full extension position, the fingers are straight and substantially coplanar to the body of the hand H. The full flection position is achieved when the fingers are curled in the palm of the hand H, that is when the hand H forms basically what is called a fist. After the full flection position, the fingers F are driven so as to uncurl and gradually straighten towards the intrinsic plus position, wherein the fingers F are straight while extending in a plane substantially perpendicular to a general plane of the dorsal portion of the hand H. With reference to FIGS. 9 and 10, the fingers F in the intrinsic plus position would extend in a straight position downwards from the hand H and thus perpendicularly from the fingers in their full extension position.

Various motions can be obtained depending on the relative positioning of the first and second rings 84 and 86, as explained hereinbefore. With the present CPM device D, any compound spiral may be obtained through a change in the gear ratios, whereby the fingers F of the patient can be submitted to various compound spiral motions corresponding to portions of various compound spirals, such as the open loop four-lobed compound spiral 140 of FIG. 13, the open loop two-lobed compound spiral 150 of FIG. 14, the open loop three-lobed compound spiral 160 of FIG. 15, and the closed loop four-lobed compound spiral 170 of FIG. 16. In any event, the CPM device D may follow various portions of different compound spirals having any number of lobes, or even fractions of a number, by changing the gear ratios in the drive system or gearing mechanism 50. Indeed, the gearing will determine the shape of the compound spiral (such as the compound spirals 140, 150, 160 and 170 illustrated in FIGS. 13 to 16), while the position of the rings 84 and 86 will determine the portion of the compound spiral along which the present CPM device D will drive the patient's fingers F, such as any one of the four reciprocal compound spiral motions 145 and 175 shown in the four quadrants respectively of the compound spirals 140 and 170 of FIGS. 13 and 16; such as any one of the two reciprocal compound spiral motions 155 shown in the two half portions of the compound spiral 150 of FIG. 14; and such as any one of the three reciprocal portions 165 of the compound spiral 160 of FIG. 15. The curvature of the compound spiral as well as the diameter of the loops thereof are determined by the gear ratios, whereas the rings 84 and 86 (which dictate the reversal of the motion) are used to set the length (or pitch) of the portion of the compound spiral along which the fingers F are displaced by the present CPM device D. Hence, for a given compound spiral determined by the gearing, the rings 84 and 86 are positioned to obtain a portion of this compound spiral which corresponds to the desired path of motion of the fingers F; and, therefore, portions, and thus reciprocal compound spiral motions, other than those (i.e. see reference numerals 145, 155, 165 and 175) illustrated in FIGS. 13 to 16 can be obtained depending on the finger motion which is desired- The compound spirals 140, 150, 160 and 170 herein illustrated all have a discrete number of lobes, although it is again noted that the path of motion of the fingers F can be taken from a compound spiral having a fraction of a lobe, such as a compound spiral having 4.2 lobes, wherein the lobes of a compound spiral having gone through more than one revolution are not necessarily superposed. Accordingly, the fingers can be driven along a predetermined compound spiral motion which corresponds to a portion of a selected compound spiral, the shape of which depends on the gearing ratios. The curvature .of the two arcs of this portion of a compound spiral as well as diameter of the loop are thus chosen to obtain the proper compound spiral motion. It is noted that the diameter of a closed loop can be zero(see the loop of the compound spiral of FIG. 16).

FIGS. 17 to 20 illustrate a variant of the motion limiting mechanism 58 of FIGS. 6 to 8, wherein similar parts have been attributed the suffix "a" to their reference numerals with respect to the numerals used in FIGS. 6 to 8. Identical parts have retained the original numerals of FIGS. 6 to 8.

A gear housing **16*a* is rotatably mounted to the motor assembly 14 and includes the gear mechanism 50 connected to the motor of the motor assembly 14, as in FIGS. 4 to 6. The gear housing 16*a* also includes the mechanism 60 for receiving and selectively positioning the digit attachment member 18 and its sub-components, namely the hole 78 for receiving the non-circular end 80 of the longitudinal rod section 108 of the digit attachment member 18, and the enlarged screw 82 for securing the latter to the mechanism 60**.

The gear housing **16*a* also comprises a modified motion limiting mechanism 58*a* which fixedly mounted with the Screws 76 to the third gear wheel 74 of the gear mechanism 50 in order to rotate therewith, as in FIGS. 3 to 8**.

Figure 17:
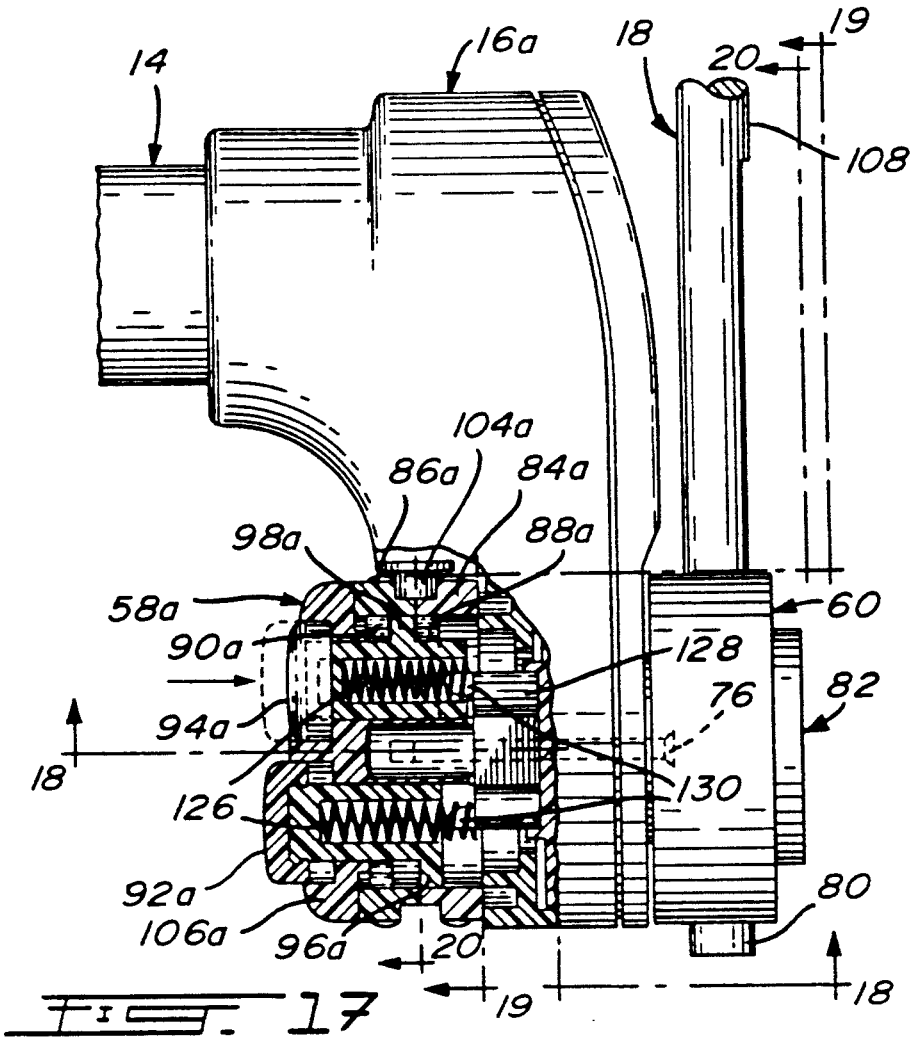
FIG. 17 is a partly cross-sectional view similar to FIG. 6 but showing another embodiment of the motion limiting mechanism.
Figure 18:
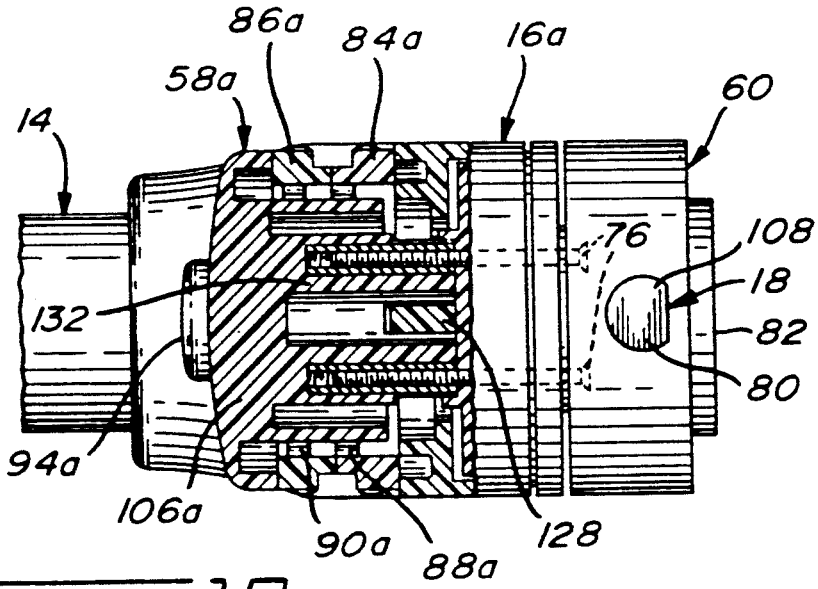
FIGS. 18 to 20 are cross-sectional views taken respectively along lines 18—18, 19—19 and 20—20 of FIG. 17.
Figure 19:
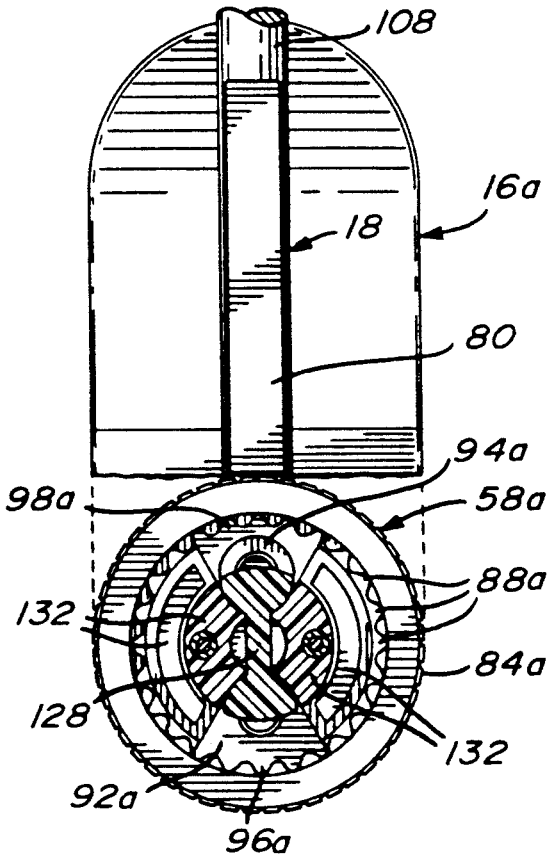
Figure 20:
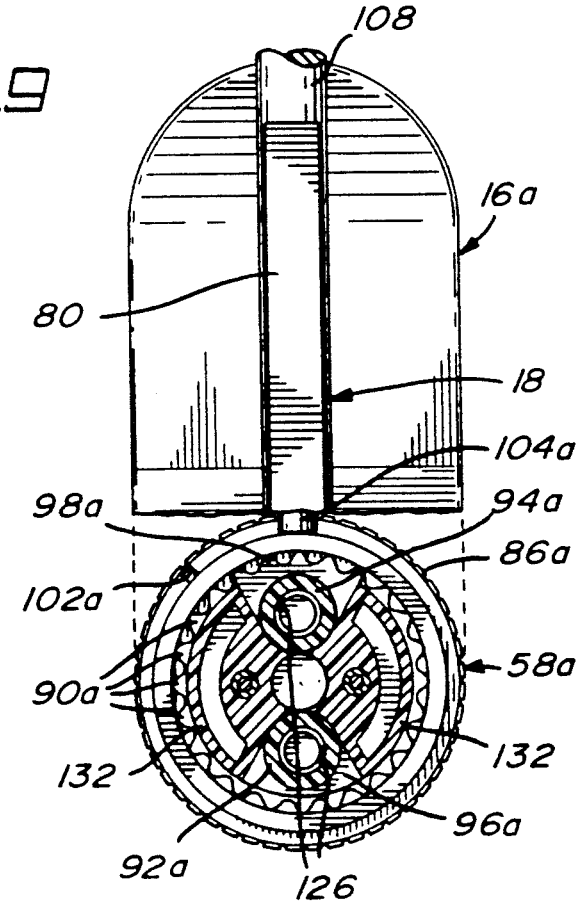

The motion limiting mechanism **58*a* is similar to the motion limiting mechanism 58 described hereinbefore, but differs therefrom with respect to the push buttons 92 and 94 and the needles 96 and 98 of the original motion limiting mechanism 58. Indeed, in the motion limiting mechanism 58*a* of FIGS. 17 to 20, a bone-shaped member 128 is mounted in the mechanism 58*a* for positioning by way of a pair of pins 130 extending therefrom a pair of springs 126 longitudinally provided within first and second push buttons 92*a* and 94*a*, as best seen in FIG. 17**.

The motion limiting mechanism **58*a* further comprises a series of parts which are functionally similar to corresponding parts of the motion limiting mechanism 58, but with shapes which defer slightly therefrom to accommodate the new structures of the push-buttons 92*a* and 94*a* and of the springs 126 dependent thereon. For instance, the motion limiting mechanism 58*a* includes first and second rings 84*a* and 86*a* which define inwardly projecting gear teeth 88*a* and 90*a*, respectively, and motor reversing tabs 100*a* and 102*a*, respectively. The motion limiting mechanism 58*a* is maintained in position by an end cap 106*a* which defines a pair of arcuate guides 132, with the bone-shaped member 128 being slidable therein. The first and second push buttons 92*a* and 94*a* include for selectively engaging and disengaging the gear teeth 88*a* and 90*a* respective arcuate members 96*a* and 98*a* which define a series of teeth which engage the gear teeth 88*a* and 90*a* of the first and second rings 84*a* and 86*a* when the push buttons 92*a* and 94*a* are in their spring-biased extended position. When the push buttons 92*a* and 94*a* are pushed in the end cap 106*a*, as seen for instance, in FIG. 17 with respect to the push button 94*a*, their arcuate toothed sections 96*a* and 98*a* disengage from respective gear teeth 88*a* and 90*a* of the first and second rings 84*a* and 86*a*, as seen in full lines in FIG. 17 for the second push button 94*a*. In this position, the rings 84*a* and 86*a* can be rotated in order to position the tabs 100*a* and 102*a* in a selected relative position with respect to one another and with respect to the digit attachment member 18. A fixed obstruction 104*a* defined on the gear housing 16*a* will again cause the reversal of the motor when abutted by one of the tabs 100*a* and 102*a* of the first and second rings 84*a* and 86*a***, respectively.

The present CPM device D enables achieve extension, full composite flection and intrinsic minus and plus positions, whereby improved range of motion recovery and enhanced tendon gliding are achieved. Various springs 118 can be provided in the digit attachment member 18 to vary the traction force on the fingers F during traction treatment. Several finger attachment clips can be provided. Such various accessory finger clips provide solutions for almost every finger attachment situation. Indeed, the finger attachment device 122 can be adapted in order-that the point of connection between the device 122 and the free end 124 of the plunger 116 is located, for instance, at the tip of the patient's finger or above the nail thereof, the latter location (which is shown in FIG. 11) applying, for example, in cases where a full flection is required as the device 122 does not impede the desired movement, whereas a connection at the tip of the finger would prevent a full flection as the connection prevents the tip of the finger from reaching the palm of the patient's hand.

It is noted that the splint 10 can be removed and the remainder of the present CPM device D can be attached to custom splints or casts.

For increased treatment flexibility, a range of motion can be isolated anywhere within a full range of motion parameters.

The first and second rings 84 and 86 and the corresponding first and second push buttons 92 and 94 can be color coded to ease the association of each push button with its respective ring, This also makes adjusting the range of motion easy. As the push buttons 92 and 94 are spring-loaded, they provide a safety lock-out mechanism.

The present CPM device D is safe as it is provided with a reverse-on-load safety circuitry, and a conveniently located on/off button and a low-battery indicator on the patient controller 20.

The motion achieved by the present CPM device D ranges from hyperextension, full composite flection to intrinsic plus position. The present CPM device D can be used to reduce postoperative pain, to maintain a good range of motion in the fingers and hand, and to prevent intra-articular adhesions and extra-articular contractures. The present CPM device D can be used for the open reduction and rigid internal fixation of intra-articular, diaphyseal and metaphyseal fractures of the phalanges and metacarpals. Other applications of the present CPM device D are as follows: capsulotomy, arthrolysis and tenolysis for post-traumatic stiffness of M.P. and P.I.P. joints; flexor and extensor tendon synovectomies; following arthrotomy and drainage of acute septic arthritis; flexor and extensor tendon tenolyses; prosthetic replacement of M.P. and P.I.P. joints; crush injuries of the hand without fractures or dislocations; burn injuries; and flexor tendon repair. On the other hand, the present CPM device D is not intended for the following applications: septic tenosynovitis, until infection is controlled; diffuse cellulitis of infection of digits, until infection is controlled; and unstable fractures.

The present CPM device D can have the following characteristics: the rate of speed thereof is 1.5 minute from hyperextension to intrinsic plus to hyperextension; the reversing force varies from 1 to 4 lbs. depending on the range of motion setting and on the position of the actuator; the power requirement of the patient controller can be 4AA (Alkaline) batteries, 6 volts; and the low battery indicator can be activated when the battery power is below 5.6 volts.

Figure 13:
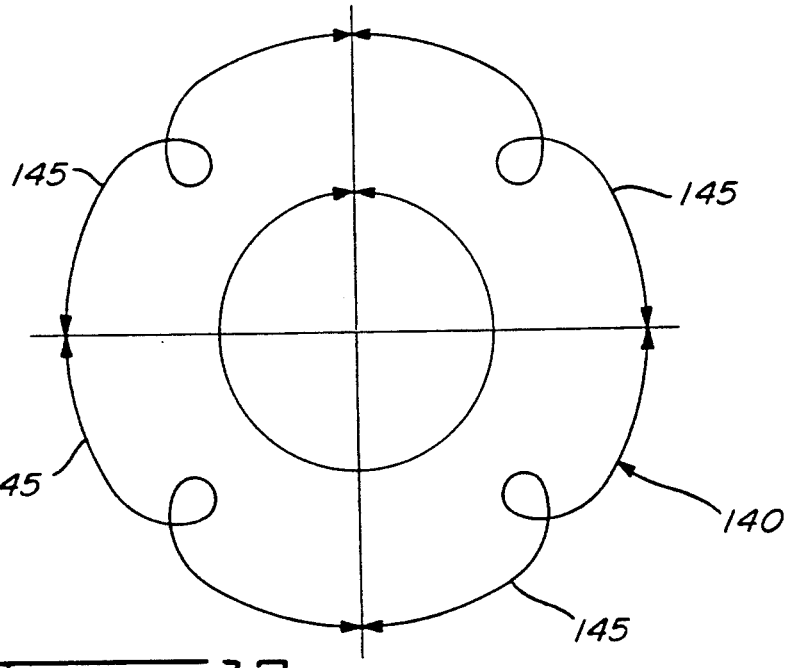
FIG. 13 is a schematic representation of an open loop four-lobed compound spiral followed by the present CPM device.
Figure 14:
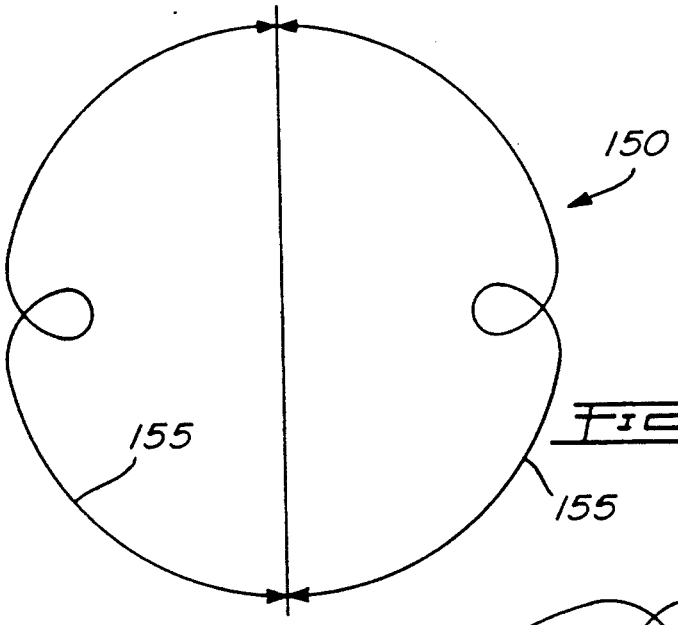
FIG. 14 is a schematic representation of an open two-lobed compound spiral followed by the present CPM device.
Figure 15:
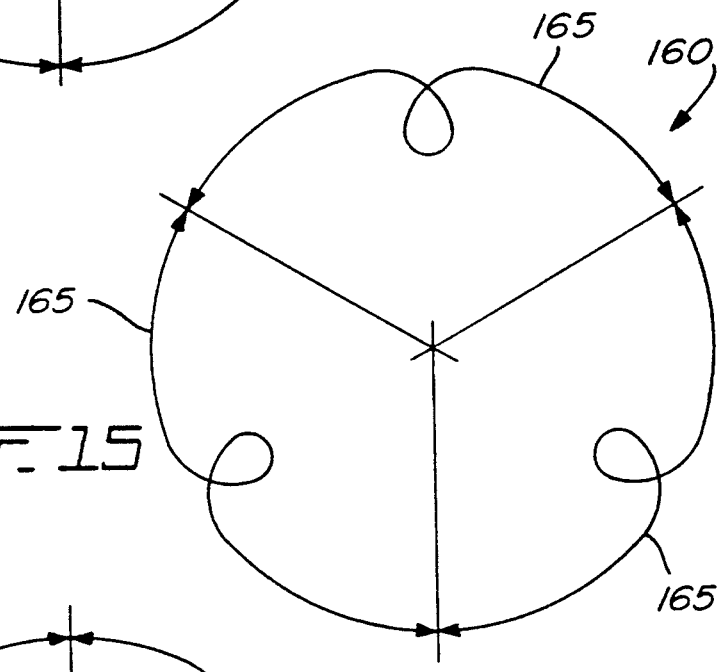
FIG. 15 is a schematic representation of an open loop three-lobed compound spiral followed by the present CPM device.
Figure 16:
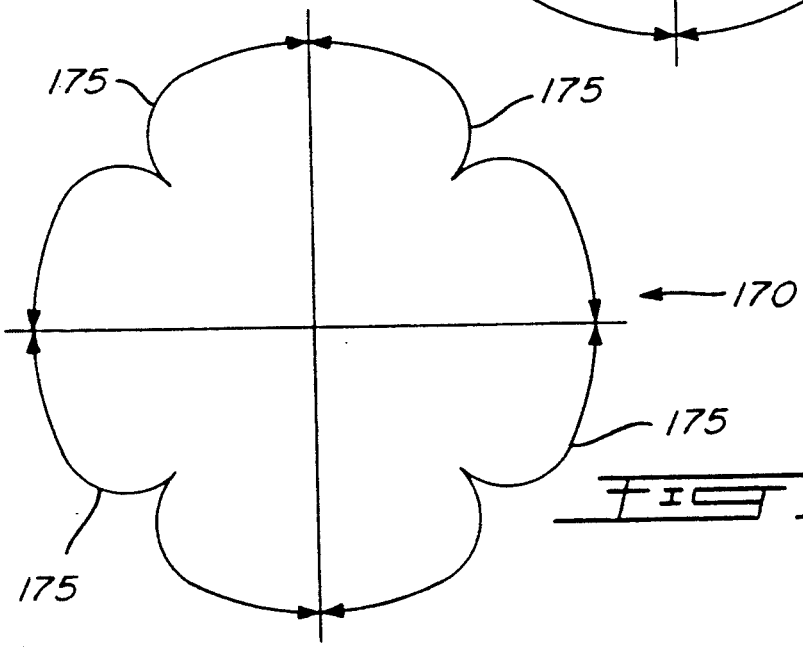
FIG. 16 is a closed loop four-lobed compound spiral followed by the present CPM device.

With reference to FIG. 13, the four-lobed compound spiral 140 illustrated therein is separated in four quadrants, with the upper right quadrant defining the portion 145 of the compound spiral 140 followed by the fingers of the left-hand during a full composite flection thereof, whereas the upper left quadrant illustrates the portion 145 of the compound spiral 140 followed by the fingers of the right-hand of the patient also during a full composite flection. FIGS. 14 to 16 illustrate various other multiple lobe compound spirals 150, 160 and, with open or closed loops, which depend on the gear ratios embodied in the gear mechanism 50 and, more particularly, in the gear clusters 52, 54 and 56. For instance, with reference to FIG. 13 and the upper right quadrant thereof, the fingers will follow the compound spiral portion 145 illustrated in this upper-right quadrant, and the motion will be reversed each time one of the two ends of the compound spiral portion 145 is reached, whereby the compound spiral portion 145 will be repeated in both directions a desired series of times, as indicated by the arrows provided on the compound spiral portion 145 of FIG. 13.

I claim:

1. A continuous passive motion device for therapy of a patient's hand comprising a splint means adapted to be attached to the patient's forearm and hand, an actuator means mounted to said splint means and comprising a motor means for driving a transmission means provided in a housing rotatably mounted to said motor means along a first axis, a digit attachment means extending from said housing and adapted for pivoting relative thereto about a second axis spaced apart from and parallel to said first axis, said digit attachment means being adapted for attachment to at least one of the patient's fingers, said transmission means upon actuation of said motor means causing said digit attachment means to counter-rotate about said second axis and relative to the rotation of said housing about said first axis, whereby said at least one finger is driven along a reciprocal path of motion corresponding at least to a portion of a compound spiral.

2. A continuous passive motion device as defined in claim 1, wherein said motor means comprises a reversible motor adapted to reverse the direction of rotation thereof when a predetermined resistance acts thereon.

3. A continuous passive motion device as defined in claim 2, wherein said transmission means comprises a gear mechanism including at least one adjustable limit means comprising an adjustable ring means adapted to rotate with the pivot of said digit attachment means and including at least one obstructing means, said housing defining at least one obstructing element, whereby the direction of said motor will be reversed when said obstructing means contacts said obstructing element during rotation of said ring means, said ring means being adapted for disengagement from said gear mechanism which causes the pivot of said digit attachment means for allowing a relative positioning of said obstructing means with respect to said digit attachment means, whereby various absolute motions of said digit attachment means can be obtained.

4. A continuous passive motion device as defined in claim 3, wherein said obstructing means comprises tab means, and wherein two adjustable ring means are provided for controlling the absolute motion of said digit attachment means, each ring means including a tab means.

5. A continuous passive motion device as defined in claim 1, wherein said transmission means comprises a gear mechanism dimensioned for producing any one of an open or closed loop compound spiral motion of varying pitches.

6. A continuous passive motion device as defined in claim 1, wherein said digit attachment means comprises a L-shaped member having a first section extending forward from said housing and a second section extending transversely in front of the patient's finger, said second section including spring loaded digit attachments substantially collinear with the patient's fingers and adapted to be attached thereto.

7. A continuous passive motion device as defined in claim 6, wherein said first section is slidable in said housing, said housing comprising locking means for securing said L-shaped member to said housing, whereby the distance between the second section and the patient's fingers can be adjusted.

8. A continuous passive motion device as defined in claim 1, wherein said motor means and said housing are slidable on said splint means in a direction substantially transverse to the axis of the patient's Gorearm and are adapted to be secured thereon in order that said digit attachment means is properly positioned with respect to the patient's at least one finger.

9. A continuous passive motion device as defined in claim 1, wherein said motor means and said housing are slidable on said splint means in a direction substantially collinear with the axis of the patient's forearm and are adapted to be secured thereon in order that said digit attachment means is properly positioned with respect to the patient's at least one finger.

10. A continuous passive motion device as defined in claim 1, wherein said transmission means comprises a gear mechanism including a first gear fixedly mounted to said motor means, a second gear driven by said motor means and collinear with said first gear, third and fourth collinear and interconnected gears, and a fifth gear, said third and fourth gears meshing respectively with said second and first gears, said fifth gear meshing with said third gear and being fixedly connected to said digit attachment means, whereby actuation of said motor means causes said second gear to rotate thus causing the rotation of said third and fifth gears and also the pivot of said digit attachment means which is interdependent of said fifth gear, the rotation of said third gear bringing about the rotation of said second gear which thus climbs around said fixed first gear along with said housing.

* * * * *